US009831620B2

(12) United States Patent
Kizhakkamparambill Paul et al.

(10) Patent No.: US 9,831,620 B2
(45) Date of Patent: Nov. 28, 2017

(54) MODULAR JACK CONNECTOR AND TERMINAL MODULE

(71) Applicant: FCI ASIA PTE, LTD., Singapore (SG)

(72) Inventors: Biju Kizhakkamparambill Paul, Cochin (IN); Nebu Pulinilkunnathil Mathew, Cochin (IN)

(73) Assignee: FCI Asia Pte. Ltd., Singapore (SG)

( * ) Notice: Subject to any disclaimer, the term of this patent is extended or adjusted under 35 U.S.C. 154(b) by 0 days.

(21) Appl. No.: 14/908,159

(22) PCT Filed: Jul. 29, 2014

(86) PCT No.: PCT/SG2014/000356

§ 371 (c)(1),
(2) Date: Jan. 28, 2016

(87) PCT Pub. No.: WO2015/016778

PCT Pub. Date: Feb. 5, 2015

(65) Prior Publication Data

US 2016/0211630 A1 Jul. 21, 2016

(30) Foreign Application Priority Data

Jul. 29, 2013 (IN) ..... 3374/CHE/2013

(51) Int. Cl.
*H01R 24/00* (2011.01)
*H01R 24/62* (2011.01)
(Continued)

(52) U.S. Cl.
CPC ..... *H01R 24/62* (2013.01); *H01R 13/405* (2013.01); *H01R 13/514* (2013.01); *H01R 24/60* (2013.01);
(Continued)

(58) Field of Classification Search
CPC ..... H01R 24/62; H01R 24/64; H01R 24/66
(Continued)

(56) References Cited

U.S. PATENT DOCUMENTS 7,618,262 B2 11/2009 Fogg et al.
7,651,379 B1 * 1/2010 Wu ..... H01R 12/62 439/108
(Continued)

FOREIGN PATENT DOCUMENTS

JP 2007-501502 A 1/2007
JP 3160343 U 6/2010
JP 2012/018768 1/2012

OTHER PUBLICATIONS

Partial Supplementary European Search Report for European Application No. 14832685.3 dated Mar. 1, 2017.

*Primary Examiner* — Abdullah Riyami
*Assistant Examiner* — Vladimir Imas
(74) *Attorney, Agent, or Firm* — Wolf, Greenfield & Sacks, P.C.

(57) ABSTRACT

A modular jack connector includes a housing defining a first direction and a second direction perpendicular to the first direction. A plurality of terminals are disposed in the housing. Each terminal having a body portion and a contact end portion connected to the body portion. Each contact end has a contact surface facing the first direction for connecting to a counterpart connector. The contact surface is a rolled surface of a metal sheet from which the contact terminals are formed. Plating process becomes more efficient and plating quality is improved, resulting in terminals with high contact surface quality being made for better electrical connectivity when connected to counterpart connectors.

19 Claims, 7 Drawing Sheets

(51) Int. Cl.

| | |
|---|---|
| ***H01R 13/405*** | (2006.01) |
| ***H01R 13/514*** | (2006.01) |
| ***H01R 24/60*** | (2011.01) |
| *H01R 12/72* | (2011.01) |
| *H01R 107/00* | (2006.01) |
| *H01R 12/58* | (2011.01) |

(52) U.S. Cl.
CPC ..... *H01R 12/585* (2013.01); *H01R 12/724* (2013.01); *H01R 2107/00* (2013.01)

(58) Field of Classification Search
USPC ..... 439/676, 660
See application file for complete search history.

(56) References Cited

U.S. PATENT DOCUMENTS

| | | | | |
|---|---|---|---|---|
| 7,727,025 | B2 | 6/2010 | Fogg et al. | |
| 7,794,278 | B2 | 9/2010 | Cohen et al. | |
| 8,070,517 | B2 * | 12/2011 | Xiong | H01R 13/65802 439/607.28 |
| 8,172,614 | B2 | 5/2012 | Kirk | |
| 8,460,032 | B2 | 6/2013 | Kirk | |
| 8,562,369 | B2 * | 10/2013 | Wu | H01R 9/032 439/345 |
| 8,753,023 | B2 * | 6/2014 | Wu | G02B 6/3817 385/88 |
| 8,801,469 | B2 * | 8/2014 | Wu | H01R 13/6477 439/607.01 |
| 8,840,321 | B2 * | 9/2014 | Wu | G02B 6/3817 385/89 |
| 8,894,451 | B2 * | 11/2014 | Shiratori | H01R 13/6471 439/660 |
| 8,905,653 | B2 * | 12/2014 | Wu | G02B 6/3817 385/93 |
| 8,974,251 | B2 * | 3/2015 | Zong | H01R 13/665 439/660 |
| 9,028,281 | B2 | 5/2015 | Kirk et al. | |
| 9,059,549 | B2 * | 6/2015 | Wu | H01R 24/62 |
| 9,065,230 | B2 | 6/2015 | Milbrand, Jr. | |
| 9,153,895 | B2 * | 10/2015 | Kao | H01R 13/65802 |
| 9,437,982 | B2 * | 9/2016 | Wu | H01R 43/20 |
| 9,461,425 | B2 * | 10/2016 | Tamaki | H01R 13/508 |
| 9,478,878 | B2 * | 10/2016 | Wu | H01R 12/53 |
| 2004/0067680 | A1 * | 4/2004 | Wu | H01R 13/6589 439/497 |
| 2006/0246770 | A1 * | 11/2006 | Wu | H01R 13/59 439/460 |
| 2009/0305532 | A1 * | 12/2009 | Hou | H01R 23/6873 439/83 |
| 2011/0034080 | A1 | 2/2011 | Su et al. | |
| 2013/0065454 | A1 | 3/2013 | Milbrand, Jr. | |
| 2013/0078870 | A1 | 3/2013 | Milbrand, Jr. | |

* cited by examiner

MODULAR JACK CONNECTOR AND TERMINAL MODULE

CROSS-REFERENCE TO RELATED APPLICATIONS

This application is the U.S. National Stage of International Patent Application Number PCT/SG2014/000356, filed Jul. 29, 2014, which claims priority to and the benefit of Indian Patent Application Number 3374/CHE/2013, filed Jul. 29, 2013. The entire contents of the foregoing are hereby incorporated herein by reference in their entireties.

TECHNICAL FIELD

The present invention relates to an electrical connector. In particular, the present invention relates to a modular jack type electrical connector and terminal module used for electrical connectors.

BACKGROUND

Contact terminals used in electrical connectors are made by stamping from a copper sheet. To improve the electrical connectivity, the contact terminals are typically plated with materials of better electrical conductivity e.g. gold. The quality, process operability and production cost of the plating process depend largely on the quality of the surface of the contact terminals being plated. Copper sheet are made by rolling process, and the main sheet surface (rolled surface) has a relatively high surface quality. Stamping process generates a cutting surface or edge on the contact terminals when the terminals are blanked off from the copper sheet. Due to design constraints, structural restrictions, manufacturing limitations, however, in some types of connectors the cutting surface or edge has to be selected as the contact surface for connecting to a counterpart connector. In such types of connectors, for example in known modular jack connectors, the plating process are carried out at the cutting surface hence it is difficult to ensure the plating quality.

It is therefore desirable to provide an electrical connector in which the contact terminals are configured to be suitable for plating and better electrical connection performance. Plating quality for terminals of such connector can be improved and with high productivity.

SUMMARY OF INVENTION

According to one aspect, embodiments of the present invention provides a modular jack connector. The modular jack connector includes a housing defining a first direction and a second direction perpendicular to the first direction. A plurality of terminals are disposed in the housing. Each terminal has a body portion and a contact end portion connected to the body portion. Each contact end has a contact surface facing the first direction for connecting to a counterpart connector. The contact surface is a rolled surface of a metal sheet from which the contact terminals are formed. Plating process becomes more efficient and plating quality is improved, resulting in terminals being made with high contact surface quality for better electrical connectivity when connected to counterpart connectors.

In one embodiment, the body portions of the terminals are disposed in a main plane. The contact end of each of the terminals is offset from the main plane along the first direction. Terminals of such configuration has a bent/curved contact end for better electrical connectivity. Such terminals may be formed by stamping a copper sheet and a bending process which may be carried out either in the same step of the stamping process or a separate step after the stamping process.

According to another aspect, embodiments of the present invention provides a terminal module for an electrical connector. The terminal module includes a support member and a pair of insert-molded parts. The support member has a cavity at a first end and a plurality of grooves at a second end. The support member defines a first direction and a second direction perpendicular to the first direction. Each insert-molded part includes a support block and a plurality of terminals. Each terminal has a body portion fixed to the support block. The support block is inserted into the cavity. A contact end of each terminal is disposed in one of the grooves. Each contact end has a contact surface facing the first direction for connecting to a counterpart connector. The contact surface is a rolled surface of a metal sheet from which the contact terminals are formed.

A terminal module according to embodiments of the present invention has terminals made by stamping and with rolled surface as the contact surface for easy plating and better electrical connectivity when connecting to counterpart connectors.

Other aspects and advantages of the present invention will become apparent from the following detailed description, illustrating by way of example the inventive concept of the present invention.

BRIEF DESCRIPTION OF THE DRAWINGS

Embodiments of the invention are disclosed hereinafter with reference to the drawings, in which.

DETAILED DESCRIPTION OF PREFERRED EMBODIMENTS

Figure 1:
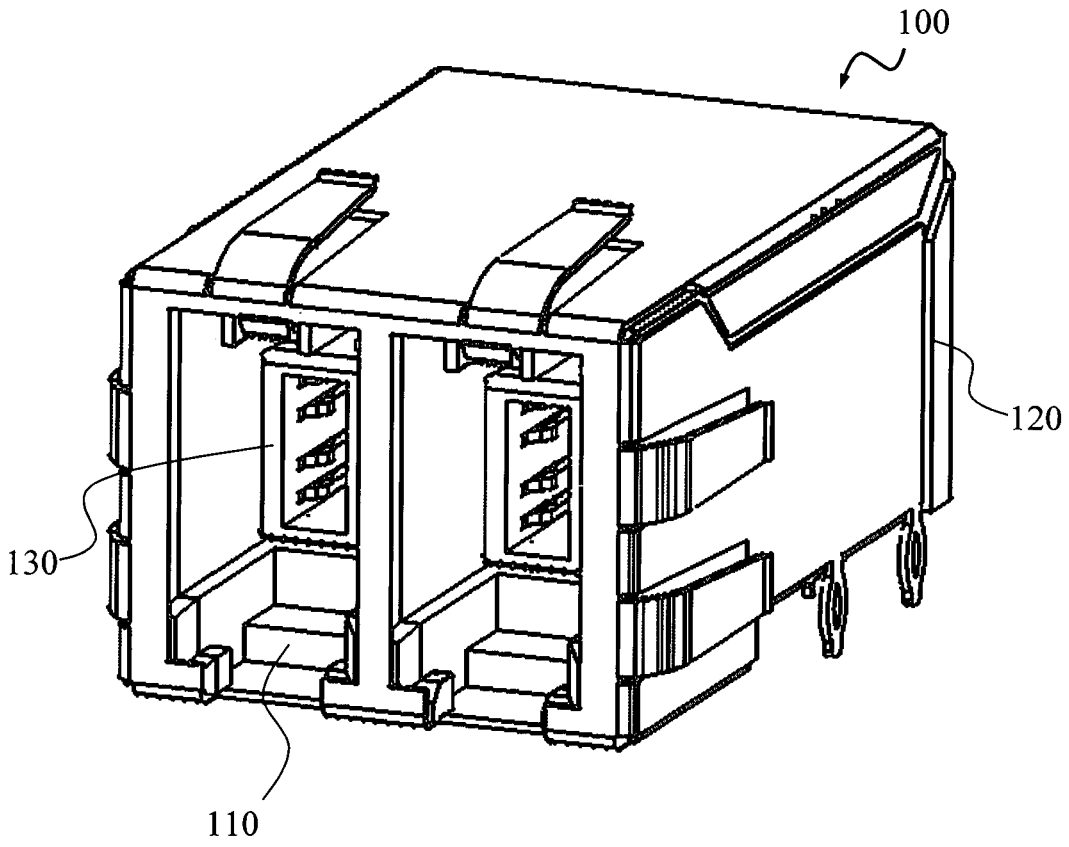
FIG. 1 is a perspective view showing a modular jack connector according to one embodiment of the present invention.
Figure 2:
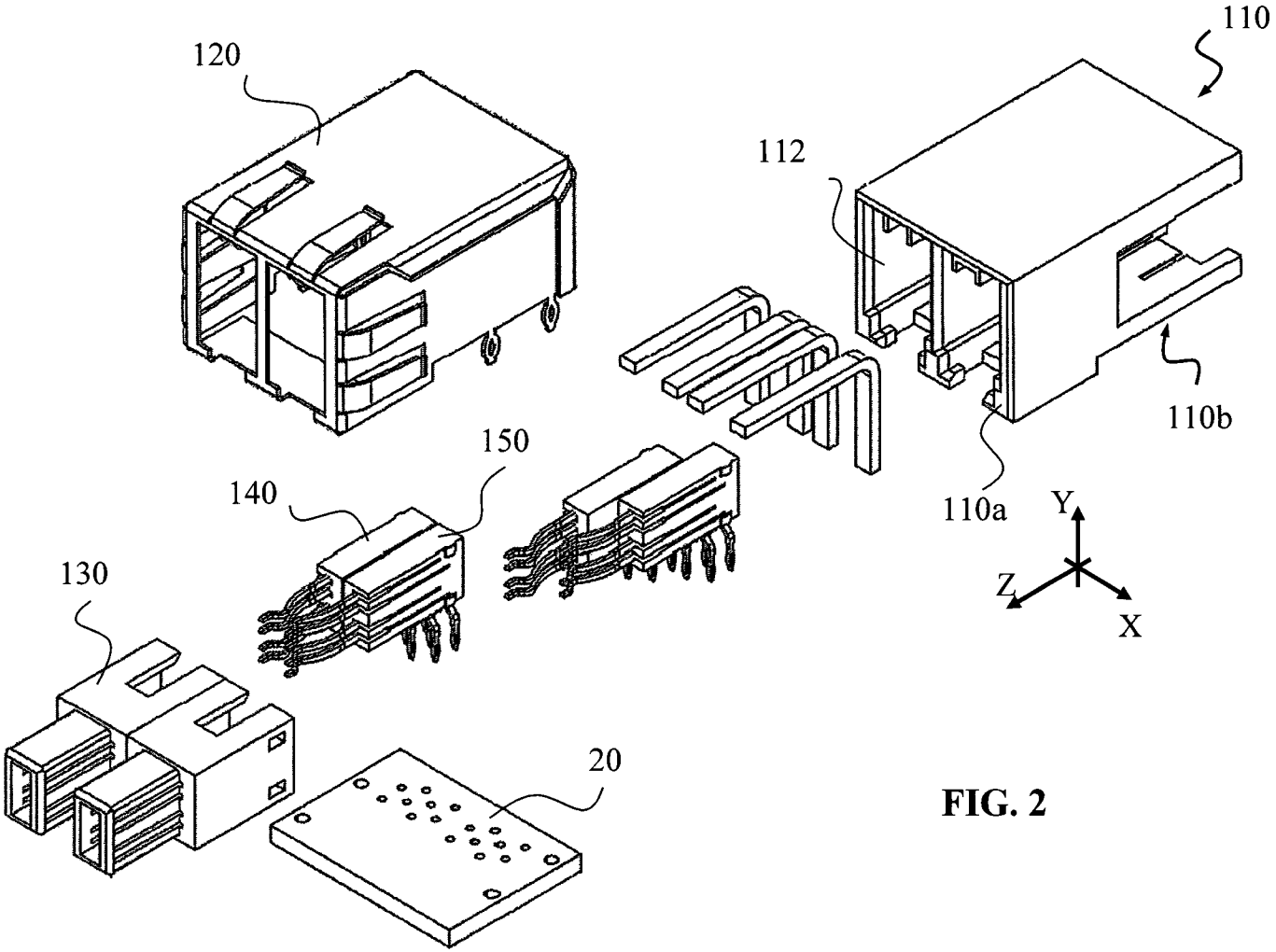
FIG. 2 is an exploded view of FIG. 1.

As shown in FIGS. 1 and 2, a modular jack connector 100 for mounting to a printed circuit board (PCB) 20 includes a housing 110 and a shield 120 covering housing 110. Housing 110 has one or more chambers 112 formed therein. Inside each chamber 112 there is disposed a support member 130 assembled to housing 110. A pair of contact modules 140 and 150 is inserted into support member 130 which is fixed to each chamber 112.

Housing 110 has a mating face 110*a* through which a counterpart connector (not shown) may be connected, and a mounting face 110*b* through which the connector is mounted to PCB 20. The housing 110 defines a first direction X and a second direction Y perpendicular to first direction X. Positions and orientations of other parts and components of connector 100 illustrated in the context are referred to with respect to first direction X and second direction Y.

Figure 3:
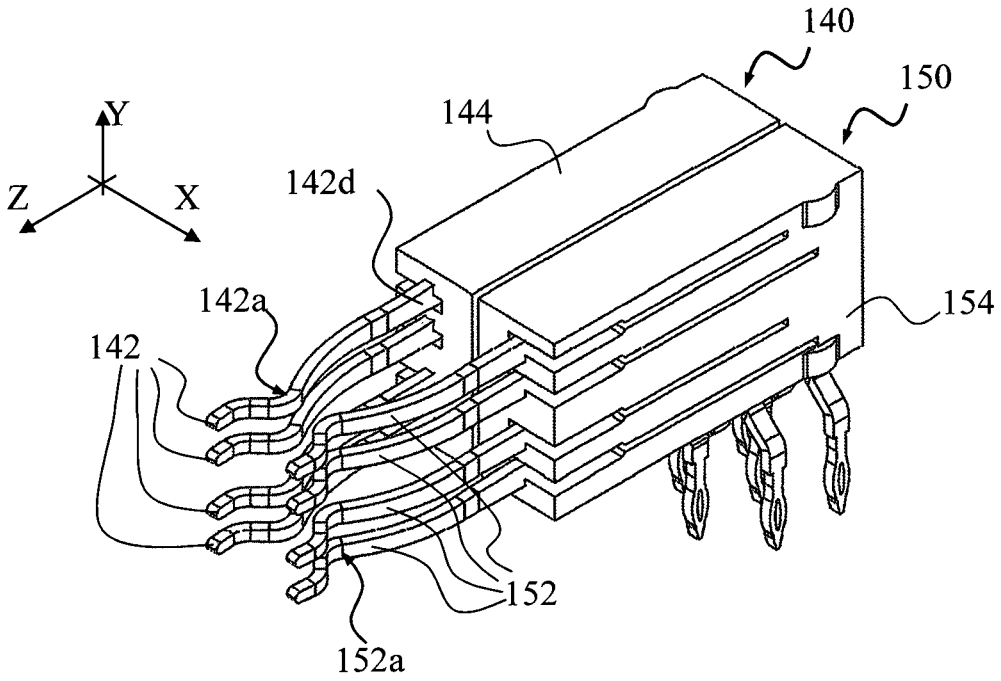
FIG. 3 is a perspective view showing an assembly of contact modules of the connector of FIG. 1.
Figure 4:
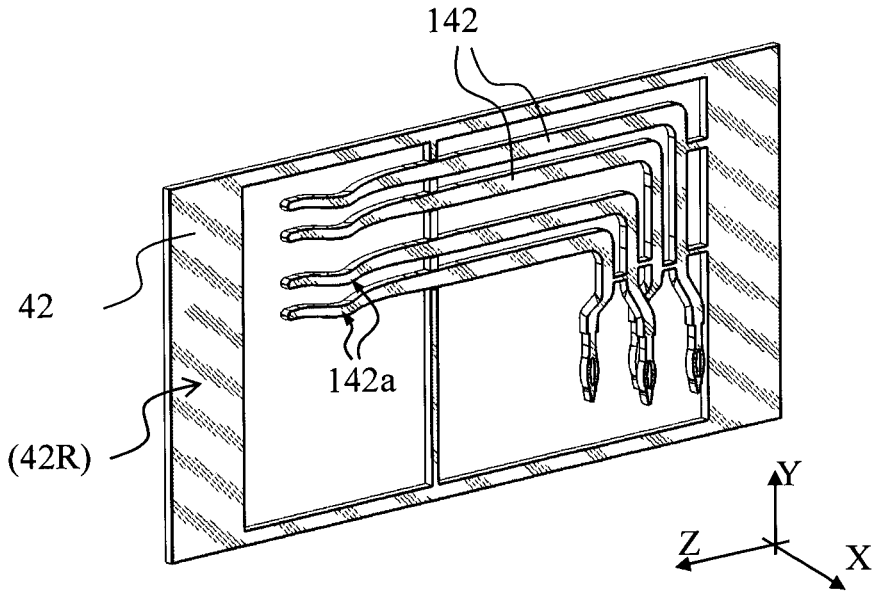
FIG. 4 is a perspective view showing a contact terminal assembly leadframe for use in a modular jack connector shown in FIG. 1.

As shown in FIG. 3, contact module 140 includes a set of contact terminals 142 which are made integral to a support block 144 by e.g. insert molding process. Each terminal has a body potion 142*d* and a contact end 142*a* connected to body portion 142*d*. When the insert-molding process is completed, body portion 142*d* is fixed to support block 144, and contact end 142*a* fixed to support block 144 in a cantilevered manner and is resiliently deflectable relative to support block 144 along X direction, for establishing electrical connection with a counterpart connector.

In the present embodiment, contact module 140 has four contact terminals 142 with contact ends 142*a* arranged along Y direction. Likewise, contact module 150 include a set of four contact terminals 152 which are made integral to a support block 154 by insert molding process. The contact ends 142*a* of contact terminals 142 are arranged along Y direction and symmetrical with respect to the contact ends 152*a* of contact terminals 152 about Y direction. Contact modules 140 and 150 are disposed side-by-side along X direction to form a connection module of eight contact terminals for electrical connection with a counterpart connector.

FIGS. 4 to 7 show a fabrication process of the contact terminals and the intermediate products of each step, and assembly into the support member 130. Taking the contact terminals 142 as an example, as shown in FIG. 3, these contact terminals are fabricated by stamping a metal sheet to form contact terminals 142 which are linked together by frame portion 42. The metal sheet is stamped along X direction such that the cutting surface is at the thickness direction of the contact terminals 142. The rolled surface 42R of the metal sheet forms the contact surface of contact terminals 142 at contact end 142*a*.

As shown in FIGS. 5A, 5B, 6 and 7, when contact terminals 142 and 152 are formed, an insert-molding process is carried out to form an integral support block 144, 154 which hold respective contact terminals 142, 152 together. Thereafter, the frame portion (only frame portion 42*a* is shown in FIG. 5 for illustration) is trimmed off to form contact modules 140, 150 to be assembled to support member 130, to form a terminal module 108.

Support member 130 has a cavity 131 formed at back end and a plurality of grooves 132 formed at front end. Contact modules 140, 150 are inserted into cavity 131, and contact ends 142*a*, 152*a* disposed in grooves 132. Contact ends 142*a*, 152*a* are movable/deflectable within the grooves 132 during the connection process with the counterpart connector.

Contact modules 140 and 150 are arranged side by side along X direction, while contact ends 142*a*, 152*a* of contact terminals 142, 152 are arranged/aligned in a column parallel to Y direction, respectively.

Figure 5A:
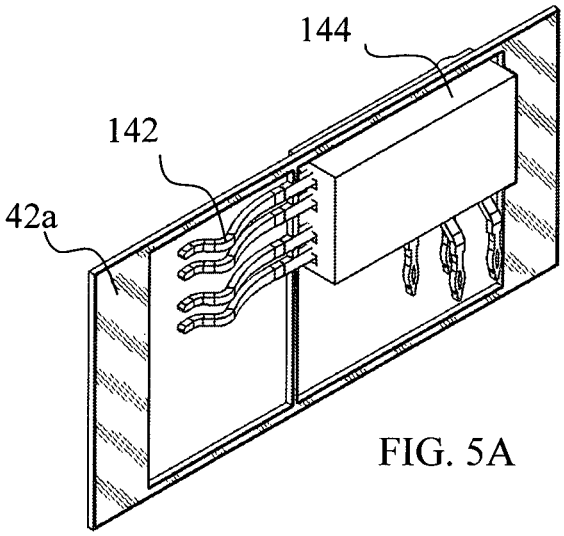
FIG. 5A is a perspective view showing an insert-molded leadframe assembly integrating the leadframe of FIG. 3.
Figure 5B:
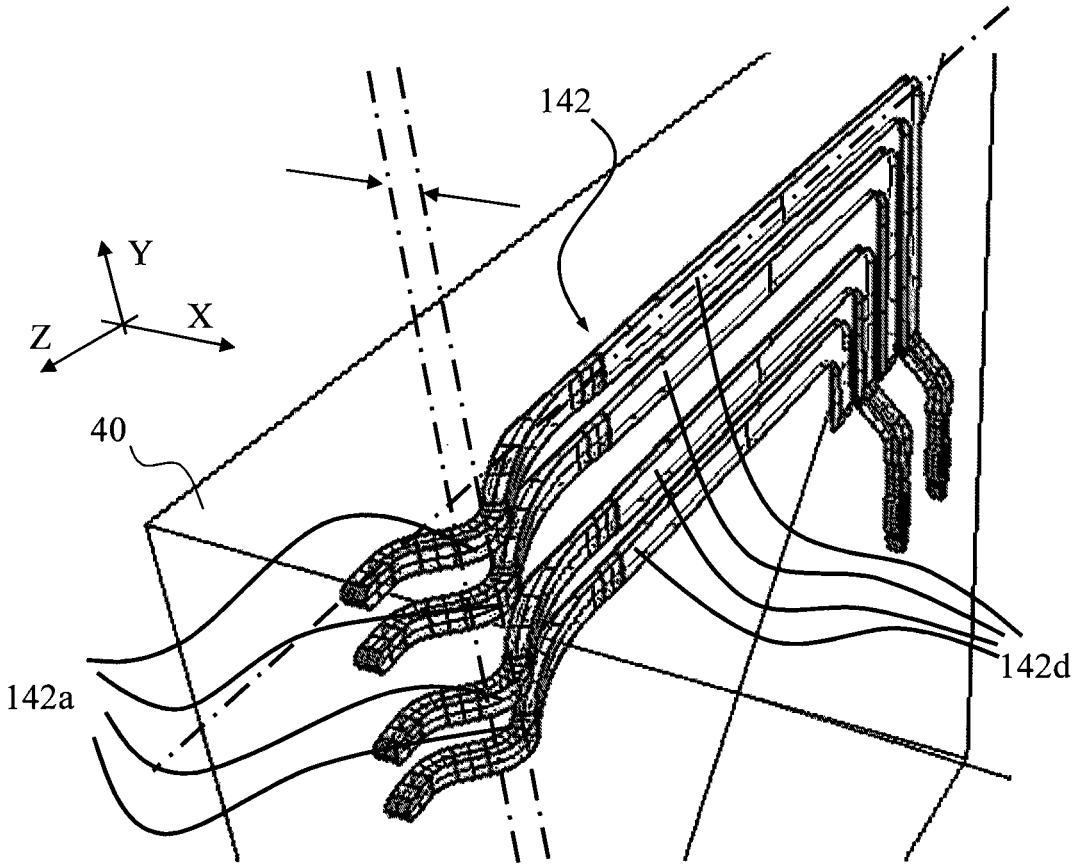
FIG. 5B is a perspective showing detailed structure of terminals of FIG. 5A after the leadframe is trimmed-off.
Figure 6:
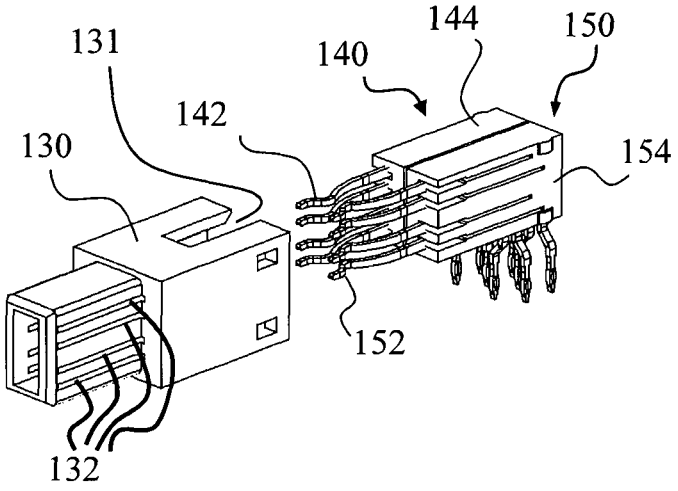
FIG. 6 is a perspective view showing the contact modules of FIG. 3 to be assembled to a support member.
Figure 7:
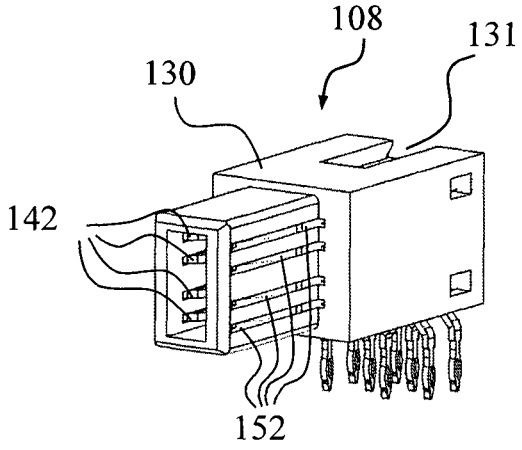
FIG. 7 is a perspective view showing the contact modules of FIG. 3 assembled to a support member to form a terminal module.

In the embodiment shown in FIG. 5B, each terminal 142 has a body portion 142*d* disposed in a main plane 40. Contact end 142*a* is offset from main plain 40 along X direction. As such, contact end 142*a* of each terminal 142 is bent from body portion 142*d* to facilitate better electrical connection with a counterpart connector.

Figure 8:
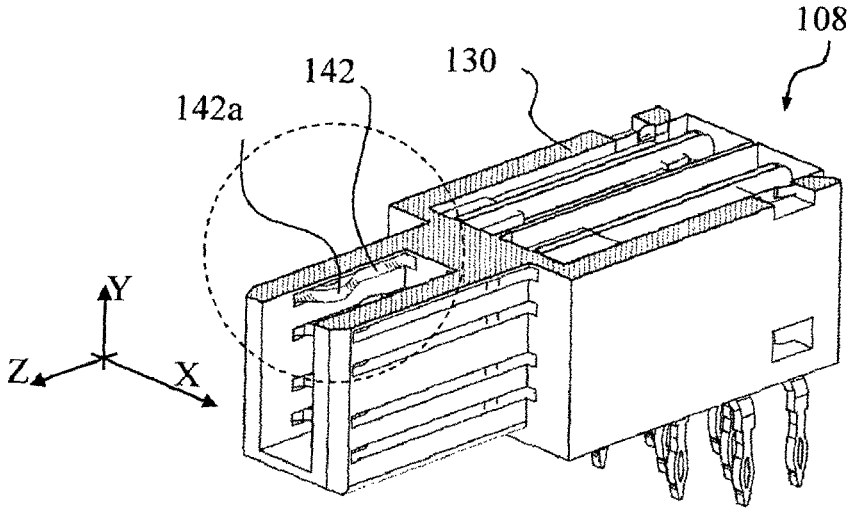
FIG. 8 is a cross sectional view of FIG. 7.
Figure 9:
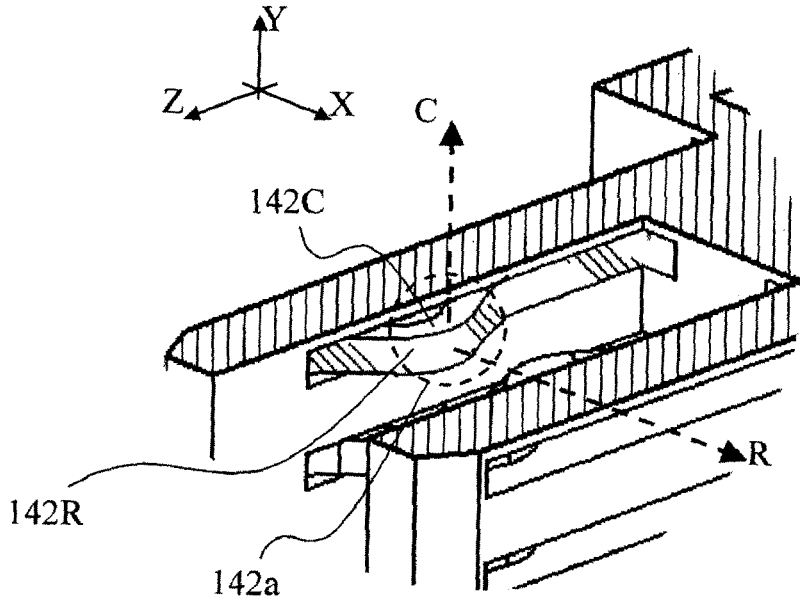
FIG. 9 is an enlarged view of FIG. 8.

As shown in FIGS. 8 and 9, when the contact modules 140 and 150 are assembled to support member 130 to form terminal module 108, the contact ends 142*a* of each contact terminal 142 has its cutting surface 142C facing Y direction, and contact surface 142R facing X direction for mating with counterpart connector. Since the contact surface 142R of all the contacts 142 and 152 are made from the roll surface 42R of the metal sheet, plating process becomes easy and high quality plating surface can be obtained on the contact ends 142*a* for electrical connections.

Figure 10:
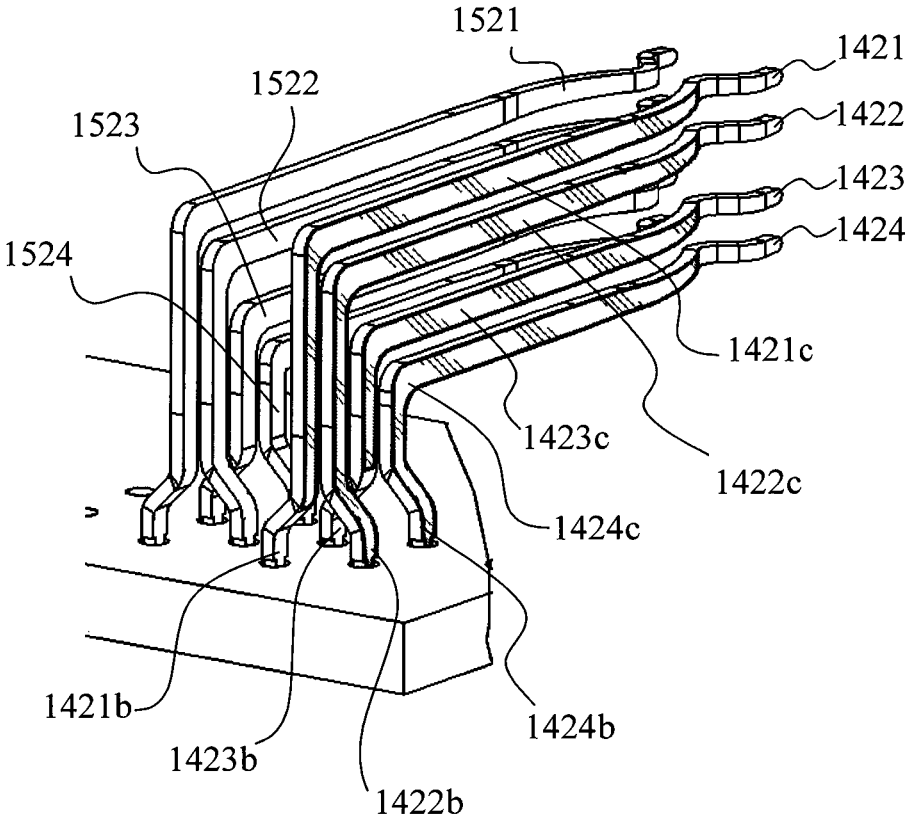
FIG. 10 is a perspective showing the solder tail configuration of the connector of FIG. 1.

The solder tail configuration of connector 100 is shown in FIG. 10. Only contact terminals 1421, 1422, 1423, 1424 and 1521, 1522, 1523 and 1524 are shown for illustrations and other parts e.g. housing, support member etc. are omitted. Solder tails of contact terminals 1421, 1422, 1423, 1424 are arranged in a staggered manner. Solder tail 1421*b* of contact terminal 1421 and solder tail 1423*b* of contact terminal 1423 are offset to one side from the body portion 1421*d*, 1423*d*. Solder tail 1422*b* of contact terminal 1422 and solder tail 1424*b* of contact terminal 1424 are offset to another side from the body portion 1422*d*, 1424*d*. Solder tails of contact terminals 1521, 1522, 1523 and 1524 are structured in a similar manner.

Although embodiments of the present invention have been illustrated in conjunction with the accompanying drawings and described in the foregoing detailed description, it should be appreciated that the present invention is not limited to the embodiments disclosed. Therefore, the present invention should be understood to be capable of numerous rearrangements, modifications, alternatives and substitutions without departing from the spirit of the invention as set forth and recited by the following claims.

The invention claimed is:

1. A modular jack connector comprising:

a housing defining a first direction and a second direction perpendicular to the first direction;

a plurality of terminals disposed in the housing, each terminal having a body portion, a contact end connected to the body portion, and a tail portion distal to the contact end and connected to the body portion, wherein the contact ends of the terminals are aligned in a column parallel to the second direction and the tail portions are elongated along the second direction, wherein the tail portions are arranged in a first plane and a first contact end of a first terminal of the plurality of terminals is disposed at a first height from the first plane, a second contact end of a second terminal of the plurality of terminals is disposed at a second height from the first plane, wherein the second height is larger than the first height, and wherein each contact end has a contact surface facing the first direction for connecting to a counterpart connector, the contact surface is a rolled surface of a metal sheet from which the terminals are formed.

2. The modular connector of claim 1, wherein the body portions of the terminals are disposed in a main plane, wherein the contact end of each of the terminals is offset from the main plane along the first direction.

3. The modular connector of claim 1, wherein the body portions of the terminals are molded to a support block to form an integral part, the contact end of each terminal being fixed to the support block in a cantilevered manner and being resiliently deflectable relative to the support block along the first direction to form electrical connection with the counterpart connector.

4. The modular jack connector of claim 3, further comprising a support member disposed in the housing, the support block being fixed in the support member.

5. The modular jack connector of claim 4, wherein the support member has a plurality of grooves within each of which the contact end of a terminal is movably disposed.

6. The modular jack connector of claim 5, wherein the contact ends of the terminals are resiliently deflectable within the grooves along the first direction to form electrical connection with the counterpart connector.

7. A terminal module for an electrical connector, the terminal module comprising:

a support member having a cavity at a first end and a plurality of grooves at a second end;

the support member defining a first direction and a second direction perpendicular to the first direction;

a pair of insert-molded parts each including a support block and a plurality of terminals each having a body portion fixed to the support block, the support block being inserted into the cavity and a contact end of each terminal being disposed in one of the grooves;

wherein each contact end has a contact surface for connecting to a counterpart connector, and wherein:

the contact surface of a terminal fixed to the support block of a first insert-molded part of the pair and the contact surface of a terminal fixed to the support block of a second insert-molded part of the pair face each other, wherein the contact surface is a convex rolled surface of a metal sheet from which the contact terminals are formed.

8. The terminal module of claim 7, wherein the contact ends being resiliently deformable within the grooves along the first direction to form electrical connection with the counterpart connector.

9. The terminal module of claim 7, wherein the pair of insert-molded parts being symmetrically disposed in the support member, the contact surface of the terminals fixed to the support block of the first insert-molded part and the contact surface of the terminals fixed to the support block of the second insert-molded part face each other to form a gap therebetween for receiving the counterpart connector.

10. The modular jack connector of claim 1, wherein:

the housing comprises a chamber in which the plurality of terminals are disposed, and the chamber is configured to receive the counterpart connector.

11. The modular jack connector of claim 10, further comprising a shield enclosing the housing on at least three sides.

12. The terminal module of claim 7, wherein:

the plurality of terminals each has a tail portion distal to the contact end and connected to the body portion, and the tail portion is elongated along the second direction.

13. The terminal module of claim 12, wherein:

the tail portions the plurality of terminals are disposed in a first plane, and the contact ends of the terminals fixed to the support block of the first insert-molded part are aligned in a column parallel to the second direction and normal to the first plane.

14. The terminal module of claim 7, further comprising a housing having a chamber in which the support member is disposed, wherein the chamber is configured to receive the counterpart connector.

15. The terminal module of claim 14, further comprising a shield enclosing the housing on at least three sides.

16. A method for manufacturing a modular jack connector, the method comprising:

stamping a rolled metal sheet having a rolled surface defining a main plane to form a plurality of terminals, each terminal having a body portion, a contact end connected to the body portion, and a tail portion distal to the contact end and connected to the body portion, wherein:

each contact end has a contact surface facing a first direction perpendicular to the main plane, wherein the contact surface is a convex rolled surface of the metal sheet and, each tail portion is elongated along a second direction in the main plane and orthogonal to the first direction;

forming a contact module by fixing the body portion of the plurality of terminals to a support block, such that the contact end of each terminal is fixed to the support block in a cantilevered manner and is resiliently deflectable relative to the support block along the first direction; and inserting the contact module into a cavity at a first end of a support member such that the contact end of the plurality of terminals is disposed in a plurality of grooves at a second end of the support member to form electrical connection with a counterpart connector.

17. The method of claim 16, wherein forming the plurality of terminals comprises forming the body portion of each terminal in the main plane and forming the contact end of each terminal offset from the main plane along the first direction.

18. The method of claim 16, further comprising inserting the support member into a chamber of a housing, the chamber configured to receive the counterpart connector.

19. The method of claim 18, further enclosing the housing on at least three sides with a shield.

* * * * *